US011309633B2

(12) United States Patent
Xiao

(10) Patent No.: US 11,309,633 B2
(45) Date of Patent: Apr. 19, 2022

(54) ANTENNA DEVICE AND MOBILE TERMINAL

(71) Applicant: BEIJING XIAOMI MOBILE SOFTWARE CO., LTD., Beijing (CN)

(72) Inventor: Jiang Xiao, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 89 days.

(21) Appl. No.: 16/793,847

(22) Filed: Feb. 18, 2020

(65) Prior Publication Data

US 2021/0119341 A1 Apr. 22, 2021

(30) Foreign Application Priority Data

Oct. 22, 2019 (CN) ..... 201911007684.7

(51) Int. Cl.

| | |
|---|---|
| ***H01Q 13/10*** | (2006.01) |
| ***H01Q 1/24*** | (2006.01) |
| *H01Q 21/20* | (2006.01) |
| *H01Q 13/02* | (2006.01) |

(52) U.S. Cl.

CPC ..... *H01Q 13/10* (2013.01); *H01Q 1/24* (2013.01); *H01Q 13/02* (2013.01); *H01Q 21/205* (2013.01)

(58) Field of Classification Search

CPC ..... H01Q 13/10; H01Q 1/24; H01Q 21/006; H01Q 21/205; H01Q 13/02

See application file for complete search history.

(56) References Cited

U.S. PATENT DOCUMENTS

| | | | | |
|---|---|---|---|---|
| 2002/0036593 | A1 | 3/2002 | King | |
| 2012/0182189 | A1* | 7/2012 | Wu | H01Q 3/24 343/702 |
| 2012/0219036 | A1* | 8/2012 | Teague | H04B 7/0691 375/141 |
| 2014/0213178 | A1 | 7/2014 | Wolff et al. | |
| 2017/0194710 | A1 | 7/2017 | Wolff et al. | |
| 2017/0250460 | A1 | 8/2017 | Shin et al. | |

OTHER PUBLICATIONS

Partial Supplementary European Search Report in the European Application No. 20158935.5, dated Sep. 16, 2020, (11p).

* cited by examiner

*Primary Examiner* — Joseph J Lauture
(74) *Attorney, Agent, or Firm* — Arch & Lake LLP

(57) ABSTRACT

An antenna device and a mobile terminal are provided. The antenna device is applied to the mobile terminal. The mobile terminal includes a middle frame and a display screen component mounted on the middle frame. The antenna device includes at least one antenna body and an excitation circuit. The antenna body is formed on the display screen component and is communicatively connected to the excitation circuit.

20 Claims, 7 Drawing Sheets

ANTENNA DEVICE AND MOBILE TERMINAL

CROSS-REFERENCE TO RELATED APPLICATION

This application is based upon and claims priority to Chinese Patent Application No. 201911007684.7, filed on Oct. 22, 2019, the entire contents of which are incorporated herein by reference.

TECHNICAL FIELD

The disclosure belongs to the technical field of communications, and more particularly, to an antenna device and a mobile terminal.

BACKGROUND

A mobile terminal includes a casing, a display circuit board mounted in the casing and a display screen component assembled on the casing. The casing is provided with an antenna radiator, and the antenna radiator is communicatively connected to/with the display circuit board. However, the mobile terminal requires communication quality and broadband data services. In particular, with the development of a 5G technology, the number of antenna radiators of/in the mobile terminal has increased. However, space for mounting the antenna radiator on the casing is limited, which leads to design bottlenecks. Communication quality is reduced, and user experience is poor.

SUMMARY

According to a first aspect of the disclosure, an antenna device is provided. The antenna device is applied to a mobile terminal. The mobile terminal includes a middle frame and a display screen mounted on the middle frame. The antenna device includes at least one antenna body and an excitation circuit. The antenna body is disposed on the display screen component and communicatively connected to the excitation circuit.

According to a second aspect of the disclosure, a mobile terminal is provided. The mobile terminal includes: a processor and a memory for storing instructions executable by the processor. The mobile terminal further includes a middle frame, a display screen mounted on the middle frame, and at least one antenna device as described above.

It is to be understood that both the foregoing general description and the following detailed description are exemplary and explanatory only and are not restrictive of the invention, as claimed.

DETAILED DESCRIPTION

Reference will now be made in detail to embodiments, examples of which are illustrated in the accompanying drawings. The following description refers to the accompanying drawings in which the same numbers in different drawings represent the same or similar elements unless otherwise represented. The implementations set forth in the following description of examples do not represent all implementations consistent with the disclosure. Instead, they are merely examples of apparatuses and methods consistent with aspects related to the disclosure as recited in the appended claims.

The terms used in the disclosure are for the purpose of describing particular examples only, and are not intended to limit the disclosure. "A/an", "the" and "this" in a singular form in the disclosure and the appended claims are also intended to include a plural form, unless other meanings are clearly denoted throughout the disclosure. It is also to be understood that term "and/or" used in the disclosure refers to and includes one or any or all possible combinations of multiple associated items that are listed.

It is to be understood that although the terms first, second, third, etc. can be used in the disclosure to describe various information, such information should not be limited to these terms. These terms are only used to distinguish the same type of information from each other. For example, without departing from the scope of the disclosure, first information can also be called second information, similarly, second information can also be called first information. For example, term "if" used here can be explained as "while" or "when" or "responsive to determining", which depends on the context.

Figure 1:
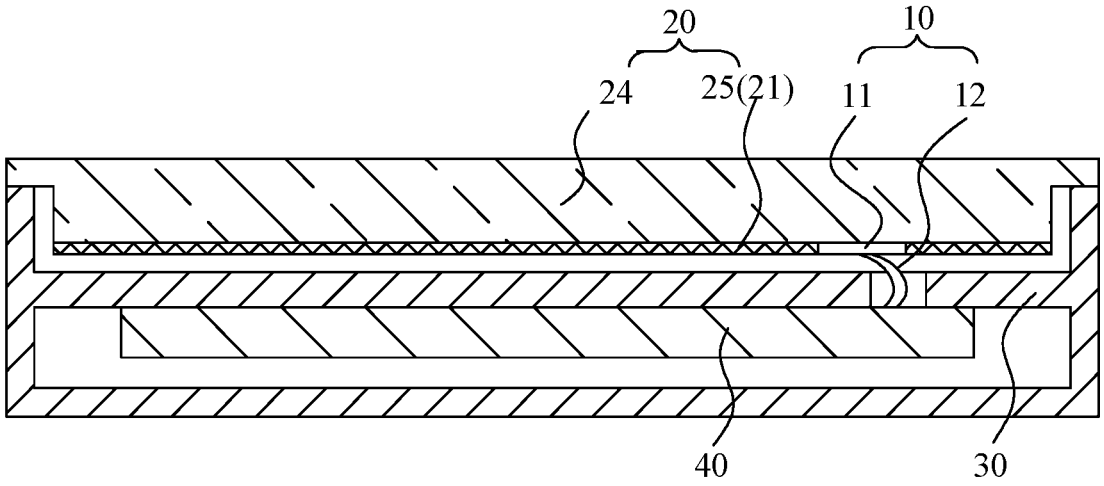
FIG. 1 is a cross-sectional structural diagram illustrating a mobile terminal, according to an example.
Figure 2:
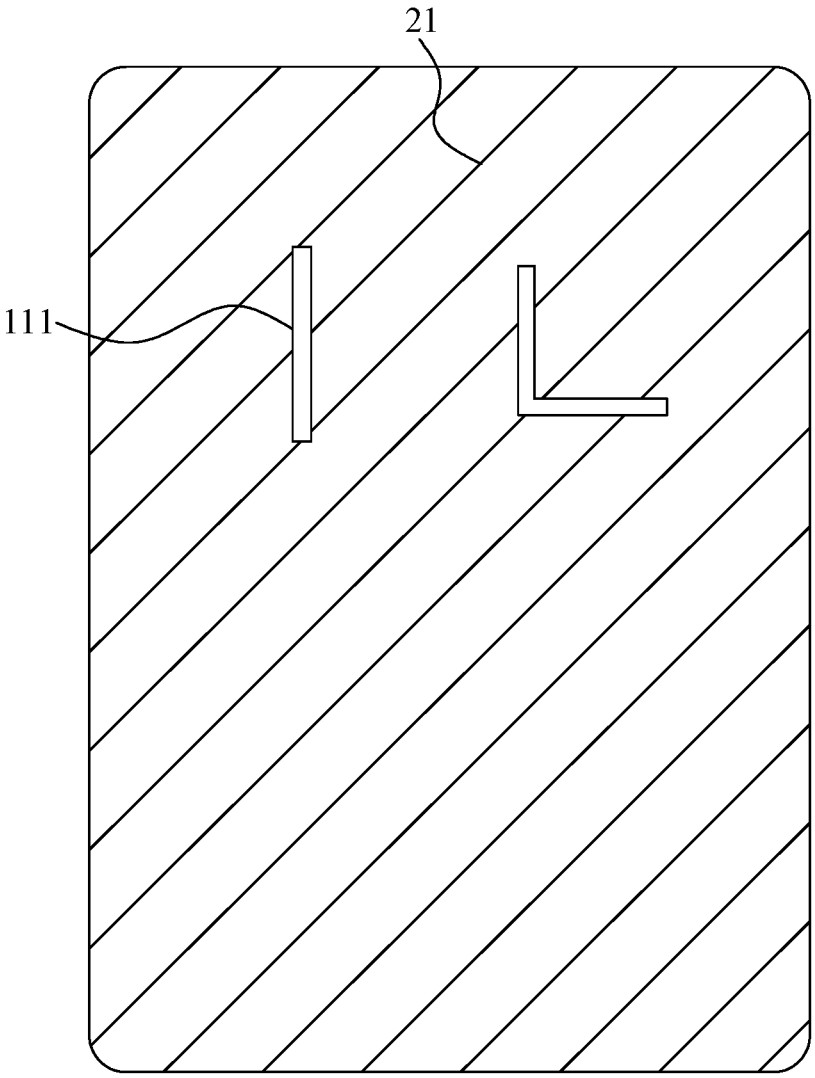
FIG. 2 is a structural diagram illustrating a slot hole in a metal protective layer, according to an example.

As illustrated in FIG. 1 and FIG. 2, an antenna device 10 is applied to a mobile terminal. The mobile terminal includes a middle frame 30 and a display screen component 20 mounted on the middle frame 30. The antenna device 10 includes at least one antenna body 11 and an excitation circuit 12. The antenna body 11 is formed on the display screen component 20 and is communicatively connected to the excitation circuit 12.

The antenna body 11 is arranged on the display screen component 20. The layout range of antennas on the mobile terminal is expanded. The communication quality of the mobile terminal is improved. Alternatively, the display screen component 20 is set as an LCD screen, a 3D curved screen, a folding screen, or a flexible screen. The at least one antenna body 11 is formed on and tightly combined with the display screen component 20. A space utilization rate is high. The antenna body 11 is arranged on the display screen component 20 and can send and receive antenna signals in 2G, 3G, 4G, and 5G bands.

The display screen component 20 includes a display body 24 and a housing portion 25. The antenna body 11 is arranged on the housing portion 25. The space of the display screen component 20 can be utilized, and the influence on a display function can be reduced. According to different structures of the display screen component 20, the housing portion 25 is set as a metal protective layer 21 made of a metal material and a non-metal protective layer 22 made of a non-metal material.

As illustrated in FIG. 1 and FIG. 2, in an example, the display screen component 20 includes a metal protective layer 21. The metal protective layer 21 is partially hollowed out to form the at least one antenna body 11. The metal protective layer 21 is arranged on an outer peripheral wall of the display screen component 20. Alternatively, the metal protective layer 21 is a metal back frame covering an outer peripheral wall of the display body. Alternatively, the metal protective layer 21 is set as a metal protective screen, such as a copper foil and the like, attached to a back of the display body.

The metal protective layer 21 made of the metal material shields or interferes with an antenna signal. A corresponding region of the metal protective layer 21 is partially hollowed out to form the antenna body 11, so that the antenna body 11 can send and receive the antenna signal. The antenna body 11 is formed in the hollowed-out region of the metal protective layer 21. The arrangement position of the antenna body 11 is well controllable, which can effectively avoid interference with the display body and expand the layout range of the antenna body 11. The metal protective layer 21 is partially hollowed out to form an antenna radiation region. The antenna body 11 is easy to process, and the structure and shape of the corresponding antenna body 11 are flexible.

In an alternative example, the metal protective layer 21 is partially hollowed out to form a through slot hole 111. The excitation circuit 12 is communicatively connected to a hole wall of the slot hole 111. The metal protective layer 21 provides a slot-shaped hollowed-out slot hole 111. The excitation circuit 12 is connected to a corresponding coupling portion of the slot hole 111 to form a slot-like antenna structure. The antenna band and slot shape of the antenna can be flexibly configured. The shape of the slot hole 111 is not specifically limited.

The excitation circuit 12 is connected to the corresponding coupling portion of the slot hole 111, so that the mobile terminal can send and receive corresponding communication signals through the antenna device 10. As illustrated in FIG. 1 and FIG. 2, in an alternative example, the mobile terminal is provided with a control circuit board 40. The control circuit board 40 is assembled on the middle frame 30. The excitation circuit 12 is disposed on the control circuit board 40. The excitation circuit 12 is arranged on the control circuit board 40, is coupled to the slot hole 111 of the metal protective layer 21, and outputs an excitation signal, which facilitates transmission of communication signals.

Figure 5:
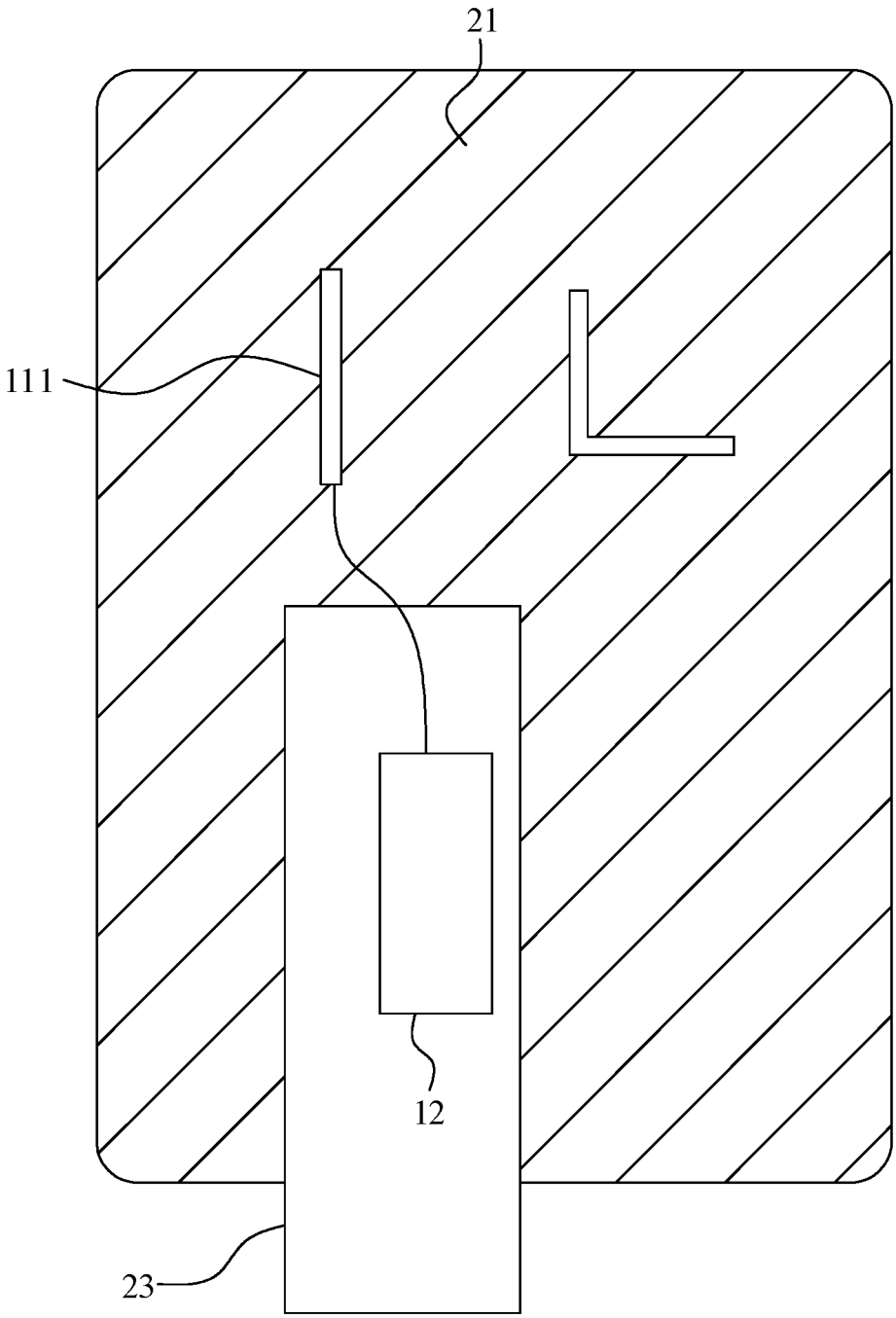
FIG. 5 is a structural diagram illustrating an excitation circuit arranged on a display screen component and communicatively connected to a slot antenna, according to an example.

As illustrated in FIG. 1 and FIG. 5, in another alternative example, the display screen component 20 includes a display circuit board 23. The excitation circuit 12 is arranged on the display circuit board 23. The display circuit board 23 is set as a signal circuit of the display screen component 20. For example, the display circuit board 23 is provided with an FPC of the display screen component 20. The excitation circuit 12 is arranged on the display circuit board 23, or a part of the FPC constitutes the excitation circuit 12. Alternatively, the display screen component 20 is further provided with other control circuits. For example, the display screen component 20 is further provided with a light-emitting control circuit. The excitation circuit 12 is provided in the light-emitting control circuit to form an under-screen antenna device 10. The excitation circuit 12 is arranged on the display screen component 20 and coupled to a slot antenna arranged on the metal protective layer 21, which facilitates signal transmission and has good sending and receiving control effects.

Figure 3:
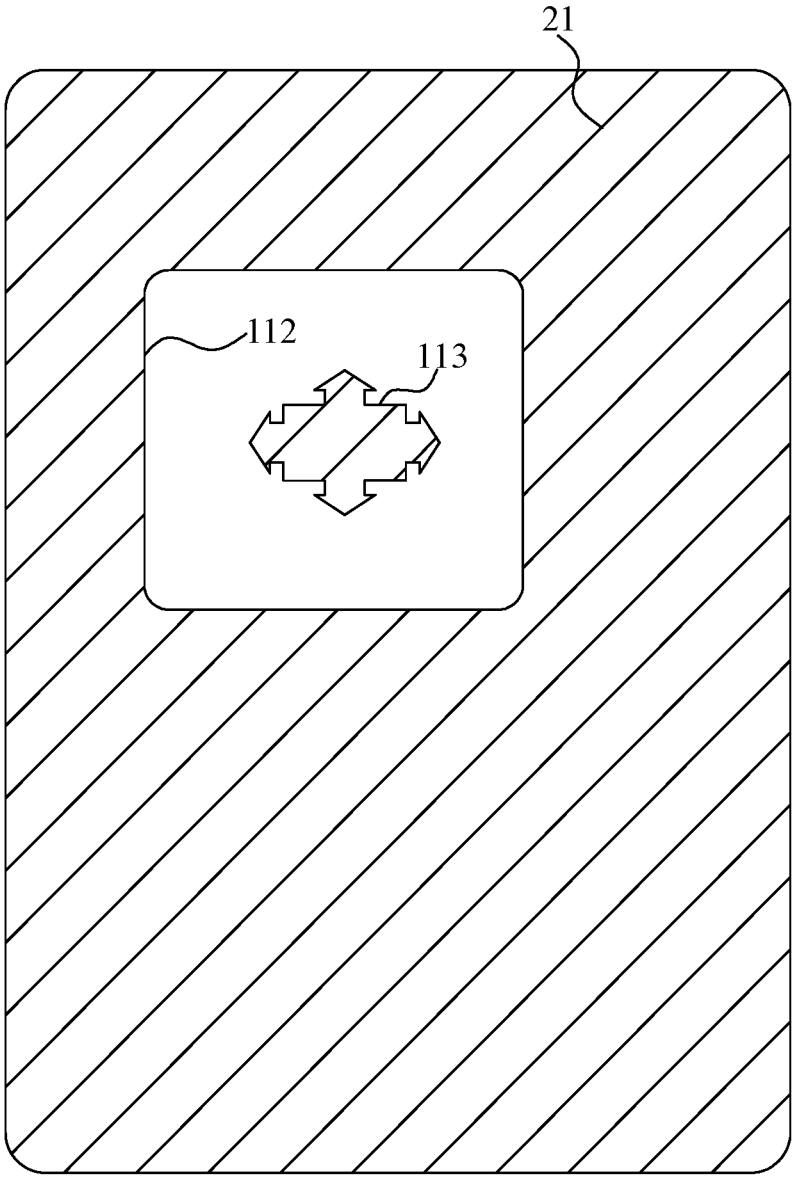
FIG. 3 is a structural diagram illustrating an antenna radiator on a metal protective layer, according to an example.

As illustrated in FIG. 1 and FIG. 3, in addition to hollowing out a structure similar to the slot antenna, the metal protective layer 21 can also be partially hollowed out to form an antenna radiator 113 structure to output corresponding antenna signals. In an example, the metal protective layer 21 is partially hollowed out to form a through avoidance hole 112 and an antenna radiator 113 located within a region range of the avoidance hole 112. The excitation circuit 12 is communicatively connected to the antenna radiator 113.

The metal protective layer 21 is hollowed out to form a hole-like region to form the avoidance hole 112. The shape of the avoidance hole 112 can be adjusted according to antenna design requirements and display effects of the display screen component 20. For example, the avoidance hole 112 can be regarded as a rectangular hole, a circular hole, a polygonal hole, and other hole-like structures. The antenna radiator 113 is located in the hole-like region of the avoidance hole 112 and spaced apart from a hole wall of the avoidance hole 112 so as to form an independent antenna radiation unit. The antenna radiator 113 can be provided with different radiator shapes according to different radiation requirements. The excitation circuit 12 is coupled to the antenna radiator 113 to form a function of sending and receiving antenna signals of different bands. The shape of the antenna radiator 113 is not specifically limited herein.

In this example, the antenna radiator 113 is detachably connected to the display screen component 20. Alternatively, a metal material in the avoidance hole 112 is hollowed out to form the antenna radiator 113 directly, and the antenna radiator is directly attached to the display body part or cemented to the display body through a cementing agent. Alternatively, the antenna radiator 113 can be processed from other materials. The material of the antenna radiator 113 is different from the material of the metal protective layer 21 so as to achieve a specific communication effect. For example, different antenna radiators 113 are formed by processing silver foil and aluminum foil. Alternatively, the antenna radiator 113 can be formed on the display body by means of laser-direct-structuring (LDS) to form an antenna radiation unit. The forming effect is good.

The excitation circuit 12 is connected to a corresponding coupling portion of the antenna radiator 113, so that the mobile terminal can send and receive corresponding communication signals through the antenna device 10. As illustrated in FIG. 1 and FIG. 3, in an alternative example, the mobile terminal is provided with a control circuit board 40. The control circuit board 40 is assembled on the middle frame 30. The excitation circuit 12 is disposed on the control circuit board 40. The excitation circuit 12 is arranged on the control circuit board 40, is coupled to the antenna radiator 113 of the metal protective layer 21, and outputs an excitation signal, which facilitates transmission of communication signals.

Figure 6:
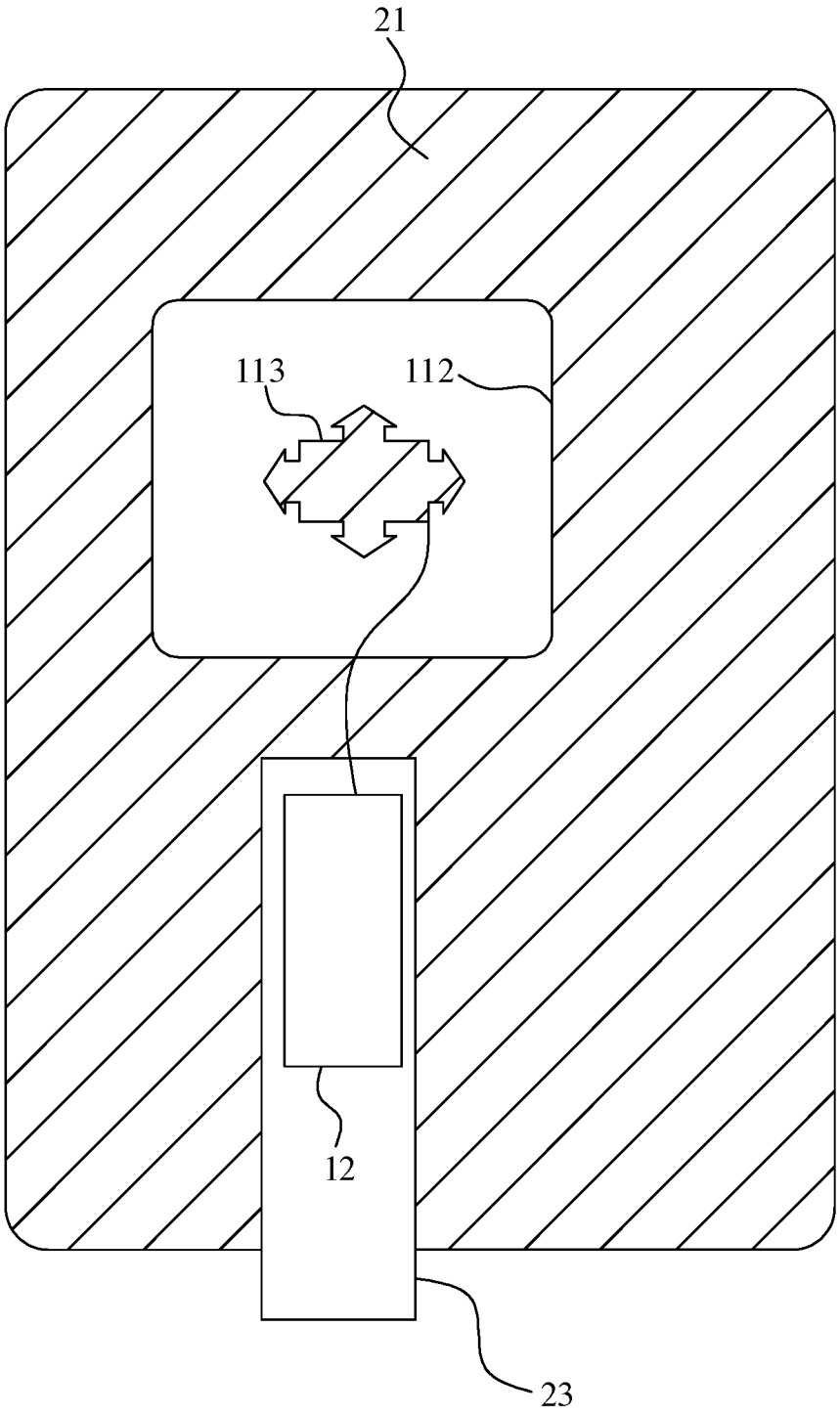
FIG. 6 is a structural diagram illustrating an excitation circuit arranged on a display screen component and communicatively connected to an antenna radiator, according to an example.

As illustrated in FIG. 1 and FIG. 6, in another alternative example, the display screen component 20 includes a display circuit board 23. The excitation circuit 12 is arranged on the display circuit board 23. The display circuit board 23 is set as a signal circuit of the display screen component 20. For example, the display circuit board 23 is provided with an FPC of the display screen component 20. The excitation circuit 12 is arranged on the display circuit board 23, or a part of the FPC constitutes the excitation circuit 12. Alternatively, the display screen component 20 is further provided with other control circuits. For example, the display screen component 20 is further provided with a light-emitting control circuit. The excitation circuit 12 is provided in the light-emitting control circuit to form an under-screen antenna device 10. The excitation circuit 12 is arranged on the display screen component 20 and coupled to the antenna radiator 113 arranged on the metal protective layer 21, which facilitates signal transmission and has good sending and receiving control effects.

Figure 4:
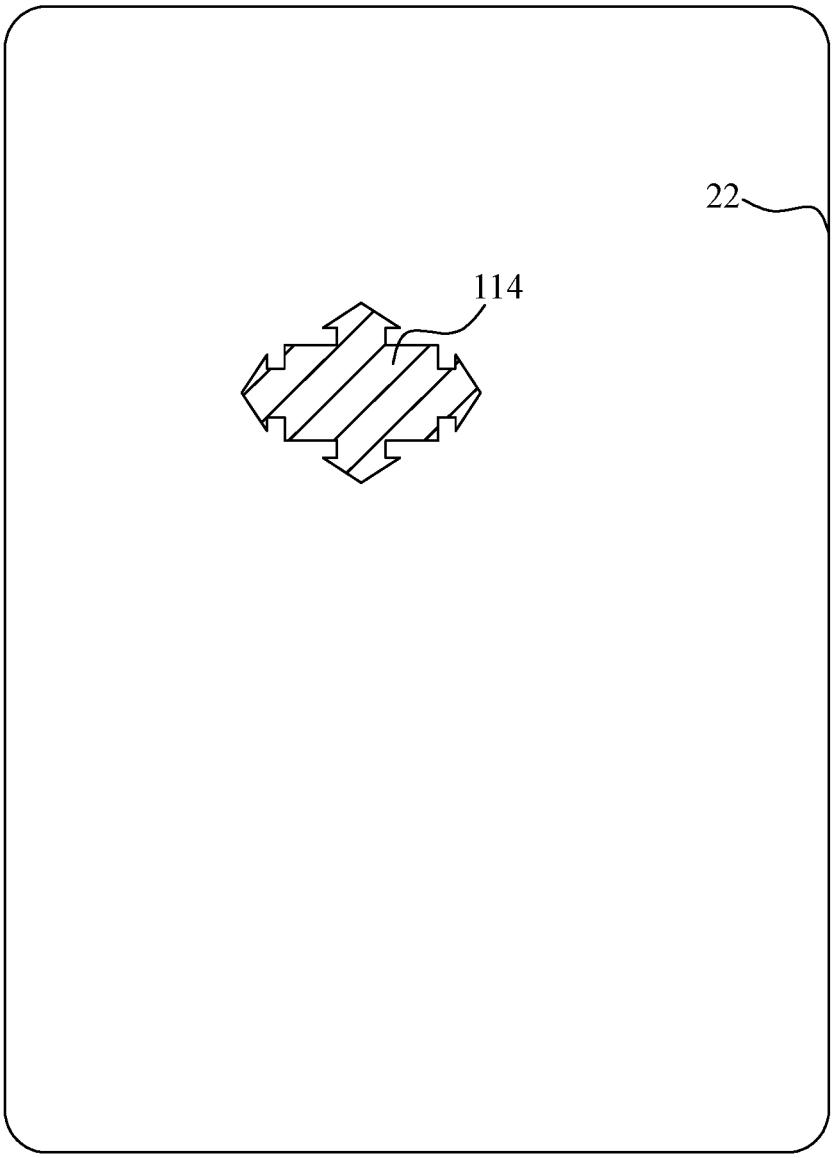
FIG. 4 is a structural diagram illustrating a screen-printed antenna radiator formed by screen-printing metal on a non-metal protective layer, according to an example.

As illustrated in FIG. 1 and FIG. 4, in an example, the display screen component 20 includes a non-metal protective layer 22 made of a non-metal material. The antenna body 11 is attached to the non-metal protective layer 22. The non-metal protective layer 22 made of the non-metal material has a small attenuation effect with the antenna signal. The antenna body 11 is attached to the non-metal protective layer 22 and can send and receive corresponding antenna signals. The excitation circuit 12 is communicatively connected to the antenna body 11, and can transmit corresponding excitation signals stably.

In this example, the antenna body 11 is attached to the non-metal protective layer 22 so as to be tightly combined into a whole. In an alternative example, the antenna body 11 is independently processed and can be cemented to the non-metal protective layer 22 by a cementing agent so as to form an integrated structure. The antenna body 11 is flexible in processing. The assembly region is flexible in adjustment. The assembly is convenient. In another alternative example, the antenna body 11 is set as a screen-printed antenna radiator 114 formed by screen-printing metal on the non-metal protective layer 22. The metal material is printed on the non-metal protective layer 22 by a screen printing process. The forming effect is good, and the processing is convenient. The antenna body 11 is processed by the screen printing process. A forming position is controllable. An antenna shape and a screen printing position are set flexibly. In another alternative example, the screen-printed antenna radiator 114 can be formed on the non-metal protective layer 22 by means of LDS to form an antenna radiation unit. The forming effect is good.

The excitation circuit 12 is connected to a corresponding coupling portion of the screen-printed antenna radiator 114, so that the mobile terminal can send and receive corresponding communication signals through the antenna device 10. In an alternative example, the mobile terminal is provided with a control circuit board 40. The control circuit board 40 is assembled on the middle frame 30. The excitation circuit 12 is disposed on the control circuit board 40. The excitation circuit 12 is arranged on the control circuit board 40, is coupled to the screen-printed antenna radiator 114 of the non-metal protective layer 22, and outputs an excitation signal, which facilitates transmission of communication signals.

In another alternative example, the display screen component 20 includes a display circuit board 23. The excitation circuit 12 is arranged on the display circuit board 23. The display circuit board 23 is set as a signal circuit of the display screen component 20. For example, the display circuit board 23 is provided with an FPC of the display screen component 20. The excitation circuit 12 is arranged on the display circuit board 23, or a part of the FPC constitutes the excitation circuit 12. Alternatively, the display screen component 20 is further provided with other control circuits. For example, the display screen component 20 is further provided with a light-emitting control circuit. The excitation circuit 12 is provided in the light-emitting control circuit to form an under-screen antenna device 10. The excitation circuit 12 is arranged on the display screen component 20 and coupled to the screen-printed antenna radiator 114 arranged on the non-metal protective layer 22, which facilitates signal transmission and has good sending and receiving control effects.

It is worth mentioning that the display screen component 20 occupies a large area and can arrange 5G antennas in corresponding regions. The 5G antennas are arranged on the display screen component 20 to transmit corresponding millimeter wave antenna signals. The 5G antenna can adopt a forming structure of the antenna body 11 disclosed in each of the foregoing examples, and the forming effect is good. Alternatively, the antenna body 11 and the excitation circuit 12 are both arranged on the display screen component 20 so as to form an integrated design, and the overall effect is good.

Figure 7:
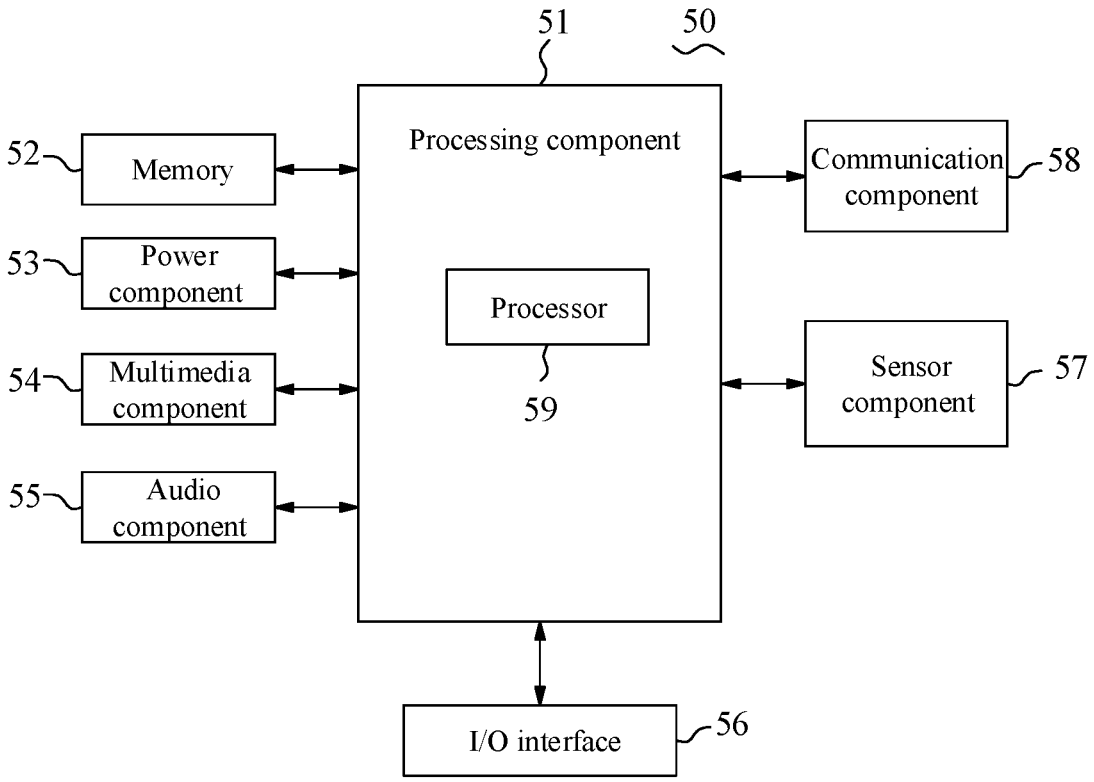
FIG. 7 is a block diagram illustrating a mobile terminal, according to an example.

As illustrated in FIG. 1 and FIG. 7, the antenna device 10 disclosed in each of the foregoing examples is applied to a mobile terminal, so that a mobile device can also provide an antenna on the display screen component 20 in addition to providing an antenna on a casing. Correspondingly, the number of antennas of the mobile terminal increases, and the communication capability is strong. In an example, the mobile terminal includes: a processor; and a memory configured to store an executable instruction of the processor. The mobile terminal further includes a middle frame 30, a display screen component 20 mounted on the middle frame 30 and at least one antenna device 10 as disclosed in the above examples.

For example, the mobile terminal 50 can be a mobile phone, a computer, a digital broadcast terminal, a messaging device, a gaming console, a tablet, a medical device, exercise equipment, a personal digital assistant, a translator, and the like.

The mobile terminal 50 can include one or more of the following components: a processing component 51, a memory 52, a power component 53, a multimedia component 54, an audio component 55, an I/O interface 56, a sensor component 57, and a communication component 58.

The processing component 51 typically controls overall operations of the mobile terminal 50, such as operations associated with display, telephone calls, data communications, camera operations, and recording operations. The processing component 51 can include one or more processors 59 to execute instructions to perform all or part of the steps in the above described methods. Moreover, the processing component 51 can include one or more modules which facilitate the interaction between the processing component 51 and other components. For example, the processing component 51 can include a multimedia module to facilitate the interaction between the multimedia component 54 and the processing component 51.

The memory 52 is configured to store various types of data to support the operation of the mobile terminal 50. Examples of such data include instructions for any applications or methods operated on the mobile terminal 50, contact data, phonebook data, messages, pictures, video, etc. The memory 52 can be implemented using any type of volatile or non-volatile memory devices, or a combination thereof, such as a static random access memory (SRAM) 52, an electrically erasable programmable read-only memory (EEPROM) 52, an erasable programmable read-only memory (EPROM) 52, a programmable read-only memory (PROM) 52, a read-only memory (ROM) 52, a magnetic memory 52, a flash memory 52, a magnetic or optical disk.

The power component 53 provides power to various components of the mobile terminal 50. The power component 53 can include a power management system, one or more power sources, and any other components associated with the generation, management and distribution of power in the mobile terminal 50.

The multimedia component 54 includes a screen providing an output interface between the mobile terminal 50 and the user. In some examples, the screen can include an LCD and a touch panel (TP). If the screen includes the TP, the screen can be implemented as a touch screen to receive input signals from the user. The TP includes one or more touch sensors to sense touches, swipes and gestures on the TP. The touch sensors cannot only sense a boundary of a touch or swipe action, but also sense a period of time and a pressure associated with the touch or swipe action. In some examples, the multimedia component 54 includes a front camera and/or a rear camera. The front camera and/or the rear camera can receive an external multimedia datum while the mobile terminal 50 is in an operation mode, such as a photographing mode or a video mode. Each of the front camera and the rear camera can be a fixed optical lens system or have focus and optical zoom capability.

The audio component 55 is configured to output and/or input audio signals. For example, the audio component 55 includes a Microphone (MIC) configured to receive an external audio signal when the mobile terminal 50 is in an operation mode, such as a call mode, a recording mode, and a voice recognition mode. The received audio signal can be further stored in the memory 52 or transmitted via the communication component 58. In some examples, the audio component 55 further includes a speaker to output audio signals.

The I/O interface 56 provides an interface between the processing component 51 and peripheral interface modules, such as a keyboard, a click wheel, buttons, and the like. The buttons can include, but are not limited to, a home button, a volume button, a starting button, and a locking button.

The sensor component 57 includes one or more sensors to provide status assessments of various aspects of the mobile terminal 50. For example, the sensor component 57 can detect an open/closed status of the device, and relative positioning of components. For example, the component is the display and the keypad of the mobile terminal 50. The sensor component 57 can also detect a change in position of the mobile terminal 50 or a component of the mobile terminal 50, a presence or absence of user contact with the mobile terminal 50, an orientation or an acceleration/deceleration of the mobile terminal 50, and a change in temperature of the mobile terminal 50. The sensor component 57 can include a proximity sensor configured to detect the presence of nearby objects without any physical contact. The sensor component 57 can also include a light sensor, such as a complementary metal oxide semiconductor (CMOS) or charge coupled device (CCD) image sensor, for use in imaging applications. In some examples, the sensor component 57 can also include an acceleration sensor, a gyroscope sensor, a magnetic sensor, a pressure sensor, or a temperature sensor.

The communication component 58 is configured to facilitate communication, wired or wirelessly, between the mobile terminal 50 and other devices. The mobile terminal 50 can access a wireless network based on a communication standard, such as WiFi, 2G, 4G, 5G, or a combination thereof. In one example, the communication component 58 receives a broadcast signal or broadcast associated information from an external broadcast management system via a broadcast channel. In one example, the communication component 58 further includes a near field communication (NFC) module to facilitate short-range communications. For example, the NFC module can be implemented based on a radio frequency identification (RFID) technology, an infrared data association (IrDA) technology, an ultra-wideband (UWB) technology, a Bluetooth (BT) technology, and other technologies.

In some examples, the mobile terminal 50 can be implemented with one or more application specific integrated circuits (ASICs), digital signal processors (DSPs) 59, digital signal processing devices (DSPDs), programmable logic devices (PLDs), Field programmable gate arrays (FPGAs), controllers, micro-controllers, microprocessors 59, or other electronic elements, for performing the above described methods.

The above is only the examples of the disclosure and is not intended to limit the disclosure. Any modifications, equivalent replacements, improvements and the like made within the spirit and principle of the disclosure should fall within the scope of protection of the disclosure.

What is claimed is:

1. An antenna device, applied to a mobile terminal comprising:

a middle frame, and a display screen mounted on the middle frame and comprising at least one antenna body and an excitation circuit, wherein the antenna body is disposed on the display screen and communicatively connected to the excitation circuit; and wherein the display screen comprises a display body and a housing portion disposed on an outer periphery or a back of the display body, the antenna body is disposed on the housing portion, and the housing portion is set as a metal protective layer made of a metal material;

wherein the display screen comprises the metal protective layer, the metal protective layer is partially carved out to form the at least one antenna body.

2. The antenna device of claim 1, wherein the metal protective layer is partially carved out to form a through slot hole, and the excitation circuit is communicatively connected to a hole wall of the slot hole.

3. The antenna device of claim 1, wherein the metal protective layer is partially carved out to form a through avoidance hole and an antenna radiator is disposed within a region range of the avoidance hole, and the excitation circuit is communicatively connected to the antenna radiator.

4. The antenna device of claim 3, wherein the antenna radiator is detachably connected to the display screen.

5. The antenna device of claim 1, wherein in response to that the display screen comprises the non-metal protective layer, the antenna body is attached to the non-metal protective layer.

6. The antenna device of claim 5, wherein the antenna body comprises a screen-printed antenna radiator formed by screen-printing metal on the non-metal protective layer.

7. The antenna device of claim 1, wherein the mobile terminal comprises a control circuit board, the control circuit board is assembled on the middle frame, and the excitation circuit is disposed on the control circuit board.

8. The antenna device of claim 1, wherein the display screen comprises a display circuit board, and the excitation circuit is disposed on the display circuit board.

9. The antenna device of claim 1, wherein the display screen is one of a liquid crystal display screen, a 3D curved screen, a folding screen, or a flexible screen.

10. A mobile terminal, comprising:

a processor, a memory for storing instructions executable by the processor, a middle frame, a display screen mounted on the middle frame, and at least one antenna device; wherein the antenna device comprises at least one antenna body and an excitation circuit, and the antenna body is disposed on the display screen and communicatively connected to the excitation circuit; and wherein the display screen comprises a display body and a housing portion disposed on an outer periphery or a back of the display body, the antenna body is disposed on the housing portion, and the housing portion is set as a metal protective layer made of a metal material;

wherein the display screen comprises the metal protective layer, the metal protective layer is partially carved out to form the at least one antenna body.

11. The mobile terminal of claim 10, wherein the metal protective layer is partially carved out to form a through slot hole, and the excitation circuit is communicatively connected to a hole wall of the slot hole.

12. The mobile terminal of claim 10, wherein the metal protective layer is partially carved out to form a through avoidance hole and an antenna radiator is disposed within a region range of the avoidance hole, and the excitation circuit is communicatively connected to the antenna radiator.

13. The mobile terminal of claim 12, wherein the antenna radiator is detachably connected to the display screen.

14. The mobile terminal of claim 10, wherein in response to that the display screen comprises the non-metal protective layer, the antenna body is attached to the non-metal protective layer.

15. The mobile terminal of claim 14, wherein the antenna body comprises a screen-printed antenna radiator formed by screen-printing metal on the non-metal protective layer.

16. The mobile terminal of claim 10, further comprising: a control circuit board, wherein the control circuit board is disposed on the middle frame, and the excitation circuit is disposed on the control circuit board.

17. The mobile terminal of claim 10, wherein the display screen comprises a display circuit board, and the excitation circuit is disposed on the display circuit board.

18. The mobile terminal of claim 11, wherein the display screen is one of a liquid crystal display screen, a 3D curved screen, a folding screen, or a flexible screen.

19. An antenna device, applied to a mobile terminal comprising:

a middle frame, and a display screen mounted on the middle frame and comprising at least one antenna body and an excitation circuit, wherein the antenna body is disposed on the display screen and communicatively connected to the excitation circuit; and wherein the display screen comprises a display body and a housing portion disposed on an outer periphery or a back of the display body, the antenna body is disposed on the housing portion, and the housing portion is set as a non-metal protective layer made of a non-metal material;

wherein the display screen comprises the non-metal protective layer, and wherein the antenna body is attached to the non-metal protective layer.

20. The antenna device of claim 19, wherein the antenna body comprises a screen-printed antenna radiator formed by screen-printing metal on the non-metal protective layer.

* * * * *